US006698114B2

(12) United States Patent
Bares et al.

(10) Patent No.: US 6,698,114 B2
(45) Date of Patent: Mar. 2, 2004

(54) LIFT ARM SUPPORT AND STORAGE CONSTRUCTION FOR SMALL LOADER

(75) Inventors: Mark F. Bares, Oakes, ND (US); James H. Page, Bottineau, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/044,104

(22) Filed: Jan. 11, 2002

(65) Prior Publication Data

US 2003/0079379 A1 May 1, 2003

Related U.S. Application Data

(60) Provisional application No. 60/335,311, filed on Nov. 1, 2001.

(51) Int. Cl.[7] ..... E02F 3/96; G02F 3/20

(52) U.S. Cl. ..... 37/403; 37/442; 224/410; 224/488; 92/23

(58) Field of Search ..... 37/405, 403, 409, 37/410, 416, 466, 442; 224/410, 401, 488; 92/23, 27; 414/713, 724–726; 107/206, 207, 216, 220

(56) References Cited

U.S. PATENT DOCUMENTS

| | | | | | |
|---|---|---|---|---|---|
| 2,397,516 | A | * | 4/1946 | Stewart | 188/67 |
| 2,458,195 | A | | 1/1949 | Pearse | 214/140 |
| 2,985,351 | A | * | 5/1961 | Shane et al. | 224/410 |
| 3,120,315 | A | * | 2/1964 | Johnson et al. | 414/694 |
| 3,135,555 | A | * | 6/1964 | Caskey | 298/22 R |
| 3,173,644 | A | | 3/1965 | Burfiend | 298/17 B |
| 3,662,653 | A | | 5/1972 | Carlson et al. | 92/15 |
| 3,905,527 | A | | 9/1975 | Chamberlain | 224/42.03 A |
| 3,982,648 | A | | 9/1976 | Luedtke et al. | 214/776 |
| 4,039,093 | A | | 8/1977 | Schmitz, Jr. et al. | 214/130 R |
| 4,043,253 | A | | 8/1977 | Albright et al. | 92/25 |

(List continued on next page.)

OTHER PUBLICATIONS

U.S. patent application of James H. Page, Ser. No. 10/044,780 filed Jan. 10, 2002, based on U.S. provisional patent application Ser. No. 60/261,296 filed Jan. 12, 2001 (this shows the machine sold under the "Maximan" trademark).

*Primary Examiner*—Thomas B. Will
*Assistant Examiner*—Thomas A. Beach
(74) *Attorney, Agent, or Firm*—Westman, Champlin & Kelly, P.A.

(57) ABSTRACT

A lift arm assembly for a small or "mini" loader is pivotally mounted onto a self propelled frame for movement between a raised and a lowered position. In the raised position, a support strut is provided that fits over an extended rod of the lift arm operating cylinder and will prevent the lift arm assembly from lowering. The support strut is stored in a front tubular cross member of the lift arm assembly. Additionally, the front cross member supports an upright strut that acts as a back stop for material in a bucket, by projecting upwardly beyond the bucket top so that if an object in the bucket tends to roll rearwardly, if the bucket is not leveled, it will be intercepted by the upwardly projecting portion of the back stop and deflected laterally.

13 Claims, 4 Drawing Sheets

U.S. PATENT DOCUMENTS

| | | | | | |
|---|---|---|---|---|---|
| 4,095,839 | A | | 6/1978 | Lawrence et al. | 296/28 C |
| 4,122,758 | A | * | 10/1978 | Bieringer et al. | 92/23 |
| 4,134,507 | A | * | 1/1979 | Piercy et al. | 414/727 |
| 4,156,488 | A | * | 5/1979 | Stark | 414/697 |
| 4,162,872 | A | * | 7/1979 | Grooss et al. | 414/713 |
| 4,189,278 | A | | 2/1980 | Dewey | 414/713 |
| 4,260,322 | A | * | 4/1981 | Cameron | 414/727 |
| 4,349,308 | A | | 9/1982 | Buckstead et al. | 414/725 |
| 4,352,626 | A | | 10/1982 | Frisbee et al. | 414/722 |
| 4,373,851 | A | * | 2/1983 | Confoey | 414/722 |
| 4,413,944 | A | | 11/1983 | Coe | 414/685 |
| 4,417,644 | A | * | 11/1983 | Brogard | 180/287 |
| 4,439,089 | A | * | 3/1984 | Anderson et al. | 414/722 |
| 4,581,979 | A | * | 4/1986 | Compton et al. | 92/23 |
| 4,674,933 | A | * | 6/1987 | Brown | 414/24.6 |
| D294,032 | S | | 2/1988 | Whiffin | D15/25 |
| 4,811,983 | A | * | 3/1989 | Watts et al. | 296/190.05 |
| 4,904,151 | A | | 2/1990 | Biemans et al. | 414/727 |
| 4,947,705 | A | * | 8/1990 | Yates et al. | 74/529 |
| 4,979,843 | A | | 12/1990 | Perry | 403/19 |
| 5,009,566 | A | * | 4/1991 | Asche | 414/722 |
| 5,388,950 | A | | 2/1995 | Schmahl et al. | 414/686 |
| D359,497 | S | | 6/1995 | Rayner | D15/25 |
| 5,542,814 | A | | 8/1996 | Ashcroft et al. | 414/786 |
| 5,575,513 | A | | 11/1996 | Tuttle | 292/339 |
| 5,590,482 | A | | 1/1997 | Peterson et al. | 37/403 |
| 5,634,762 | A | * | 6/1997 | Kim | 414/685 |
| 5,993,139 | A | | 11/1999 | Deneve et al. | 414/722 |
| D431,574 | S | | 10/2000 | Porter | D15/25 |
| 6,146,081 | A | | 11/2000 | Anderson | 414/685 |
| 6,171,050 | B1 | | 1/2001 | Johnson | 414/685 |
| D438,218 | S | | 2/2001 | McIlwraith | D15/25 |
| 6,224,161 | B1 | | 5/2001 | Hansen et al. | 398/17 T |

* cited by examiner

LIFT ARM SUPPORT AND STORAGE CONSTRUCTION FOR SMALL LOADER

This application refers to and claims priority from Provisional Application Serial No. 60/335,311 filed Nov. 1, 2001, the content of which is incorporated by reference.

BACKGROUND OF THE INVENTION

The present invention relates to a lift arm assembly construction for use on a small loader that is operated from the rear of the loader. The lift arm assembly can be raised for lifting loads. A mechanical support is provided for holding the lift arms in their raised position and is stored in a cross member of the lift arm assembly. The lift arm assembly has a upright strut for intercepting and deflecting objects that may roll from the back of the bucket if the bucket is overfull and the lift arm assembly is fully raised.

Skid steer loaders commonly use a mechanical stop that will carry compression loads and is placed between the rod end cap of an extended cylinder and the lift arm so that the lift arm will not lower and the cylinder cannot retract. Mechanical stops are used when the loader is being serviced. Various mechanical stops that will retract under a spring load have been advanced. In small or mini loaders, space is limited, and compact lift arm geometry is such that typical retractable stop designs cannot be integrated.

SUMMARY OF THE INVENTION

The present invention relates to a small, self propelled loader with a lift arm assembly that can be raised and lowered.

Controls for the lift arms and ground drive are all at the rear of the machine, and accessible by an operator standing on the ground or standing on a support platform at the rear of the machine. The lift arm pivots are generally a little higher than waist high on an operator. The operating control levers are just to the rear of the lift arm pivots for accessibility of the operator.

The lift arms are made into a rigid lift arm assembly with a cross member at the front end of the lift arms that also supports an upright strut for mounting a cylinder or actuator that is used for tilting the bucket or work implement.

With the lift arms pivoted upwardly so the load is raised the maximum amount in the small loader, there can be a substantial roll back or tilt back of the bucket. A structural member is integrated into the strut that mounts the cylinder for tilting the bucket. The structural member acts as a backstop for intercepting and deflecting objects, such as logs or rocks that may fall from the bucket when the lift arms are raised to the top of their travel and the load is not kept level.

The cross member of the lift arm assembly opens through one side of lift arms and is utilized for storing a mechanical support that holds the lift arms in their raised position when the loader is serviced. This eliminates the need for storing the support externally of the lift arm, where it can be in the way or add to the size of the small loader. The support has a key shaped end that includes a tang that fits into a recess formed between side plates to provide a way of knowing the correct orientation for installation.

DETAILED DESCRIPTION OF THE ILLUSTRATIVE EMBODIMENTS

Figure 1:
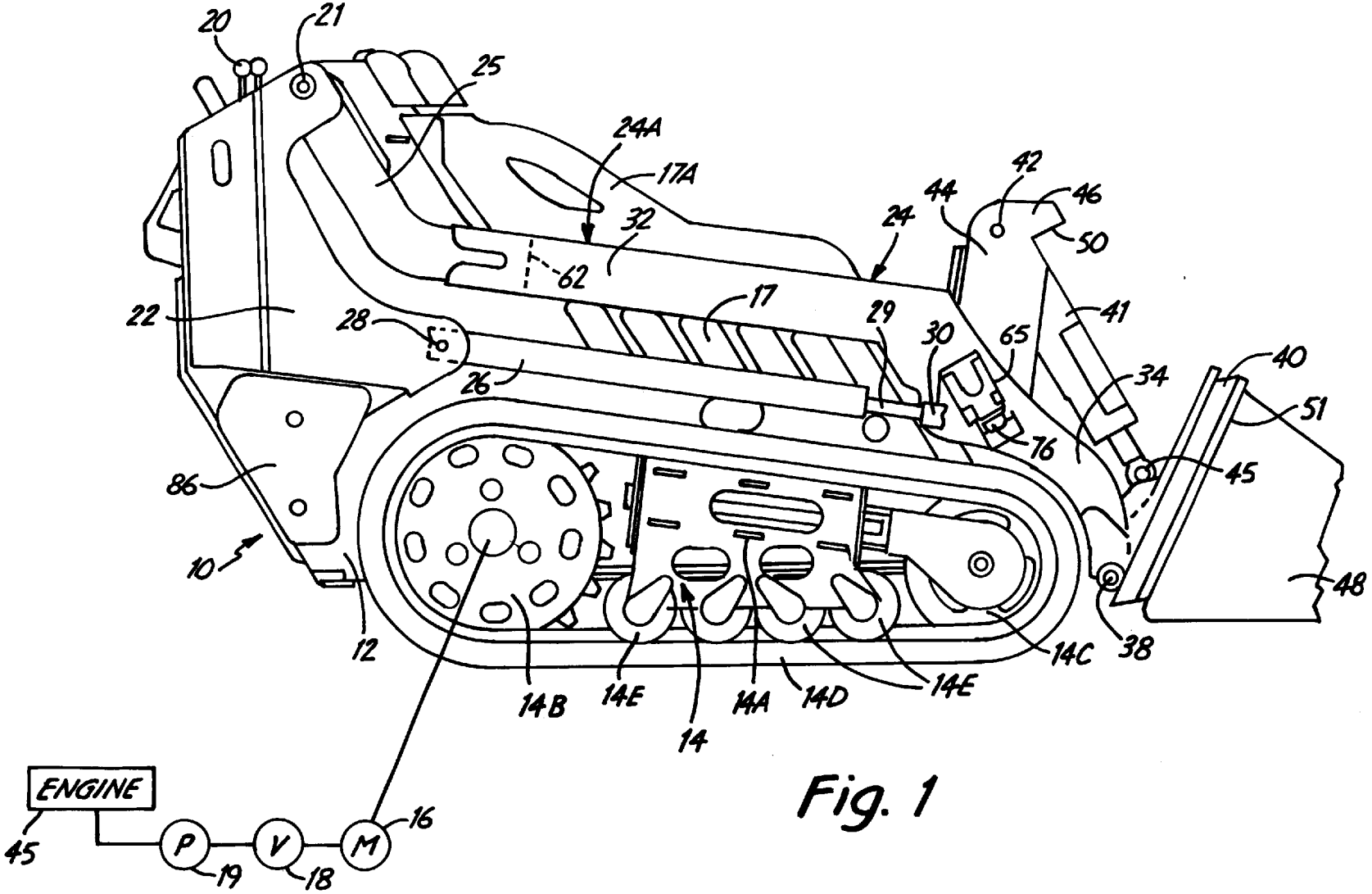
FIG. 1 is a side elevational view of a small, compact walk behind loader made according to having lift arms constructed according to the present invention.

Referring to FIG. 1, a miniature (mini) loader indicated generally at 10 is a walk behind power loader that has a body or frame 12. The frame 12 supports a track assembly 14 on each side of the loader for propelling the loader 10 in forward and reverse directions through the use of drive hydraulic motors indicated generally at 16. The drive motors are hydraulic motors operated through a pump 19 and a valve arrangement with a valve 18 which is part of hydraulic valve controls 20 at the upper end of a control panel for the loader. The pump 19 is driven by an internal combustion engine 45 mounted on the body or frame in a housing 17 that has a cover 17A.

Each track assembly includes a track frame 14A, a drive sprocket 14B and a front idler wheel 14C over which a track 14D is mounted. Bogie wheels 14E are also provided on the track frame for support.

The body or frame 12 has spaced plates forming upright supports 22 at the rear portions, and these supports 22 extend upwardly a little higher than waist level of an operator standing on the ground. The upright supports in turn pivotally support base or rear ends of the lift arm assembly 24 on pivots 21.

The lift arm assembly 24 includes individual lift arms 24A and 24B, on opposite sides of the body or frame, and each lift arm has a base end portion 25 that inclines downwardly at an angle essentially parallel to the rear portions of the body frame and engine cover. The base portion 25 of each lift arm joins a side lift arm portion 32 that extends parallel to the upper length 14F of the respective track 14D of the track assembly on that side of the loader with the lift arm assembly in a lowered position. The side lift arm portions 32 join forward lift arm portions 34 that fit around the front of the drive tracks, 14D, respectively.

The lift arm assembly 24 is raised and lowered with extendible and retractable double acting hydraulic cylinders or actuators 26 operating with hydraulic pressure from the pump 19 and controlled by valves forming part of the controls 20.

The cylinders 26 (there is one on each side, and only one is shown) have base ends pivotally mounted as at 28 to the upright portions of the body or frame 12, and the cylinders have extendible and retractable rods 29 that have rod ends that are pivotally mounted as at 30 to each of the side lift arm portions 32 of the lift arm assembly 24. The lift arms 24A and 24B include the side lift arm portions 32, and forwardly extending lift arm portions 34 that curve forwardly over the forward ends 36 of the drive tracks. Pivot pins 38 in turn are used for mounting a quick attachment plate 40 of conventional design normally used with the BOBCAT® skid steer loaders made by Bobcat Company, an unincorporated Business Unit of Clark Equipment Company.

The attachment plates 40 are well known, and the pins 38 permit the attachment plate to be pivoted about a horizontal axis by a bucket control cylinder 41 that has its base end connected as at 42 to an upright strut 44 mounted on a cross member 70. Member 70 holds the lift arms 24A and 24B together to form the lift arm assembly 24. The rod end of the actuator or cylinder 41 is connected as at 45 to a bracket on the attachment plate 40. A bucket 48 is shown in position on the attachment plate 40, and this is supported on the attachment plate 40 in a known manner.

Figure 2:
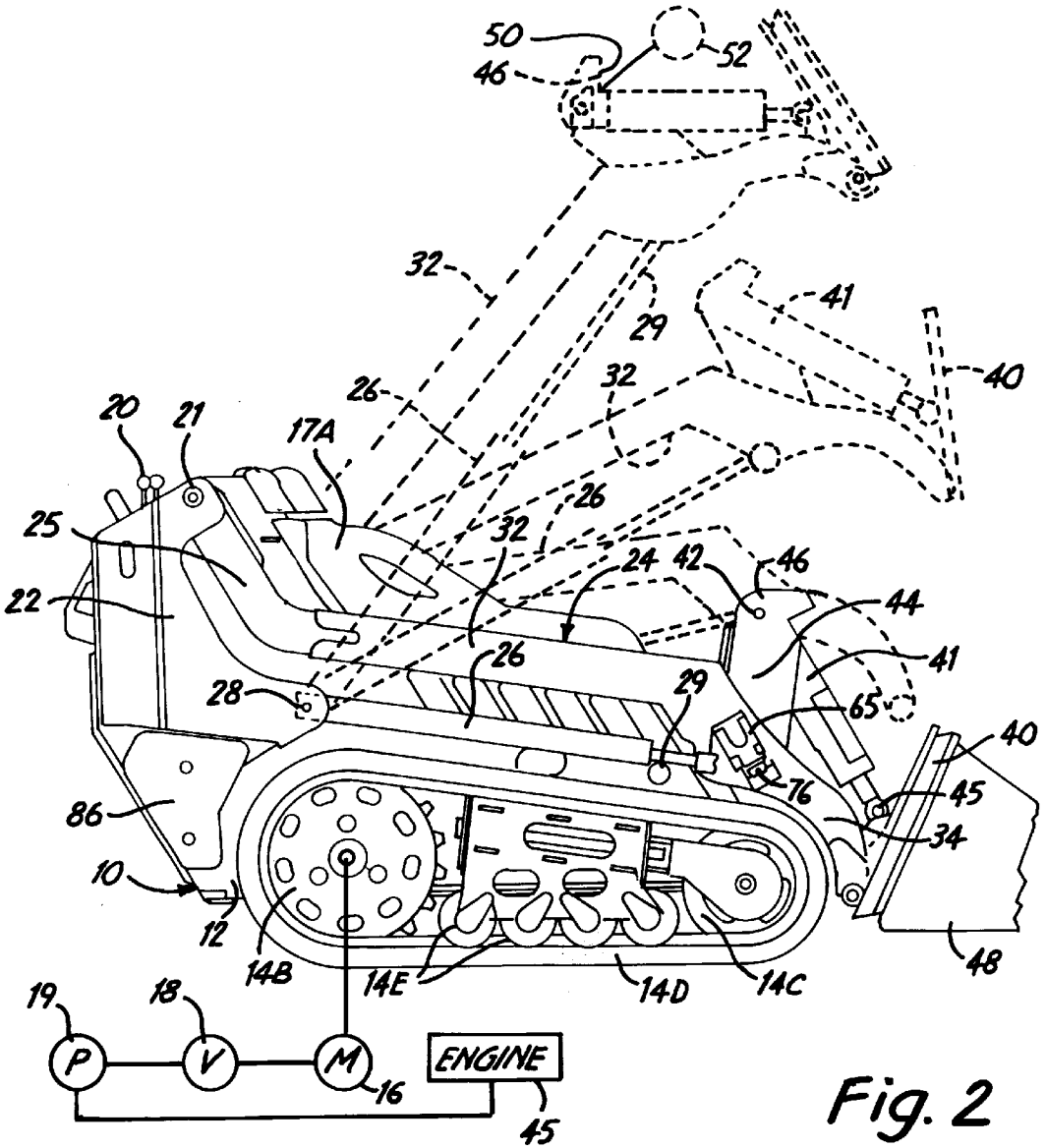
FIG. 2 is a side view of the loader of FIG. 1 showing the lift arm in raised position in dotted lines.
Figure 3:
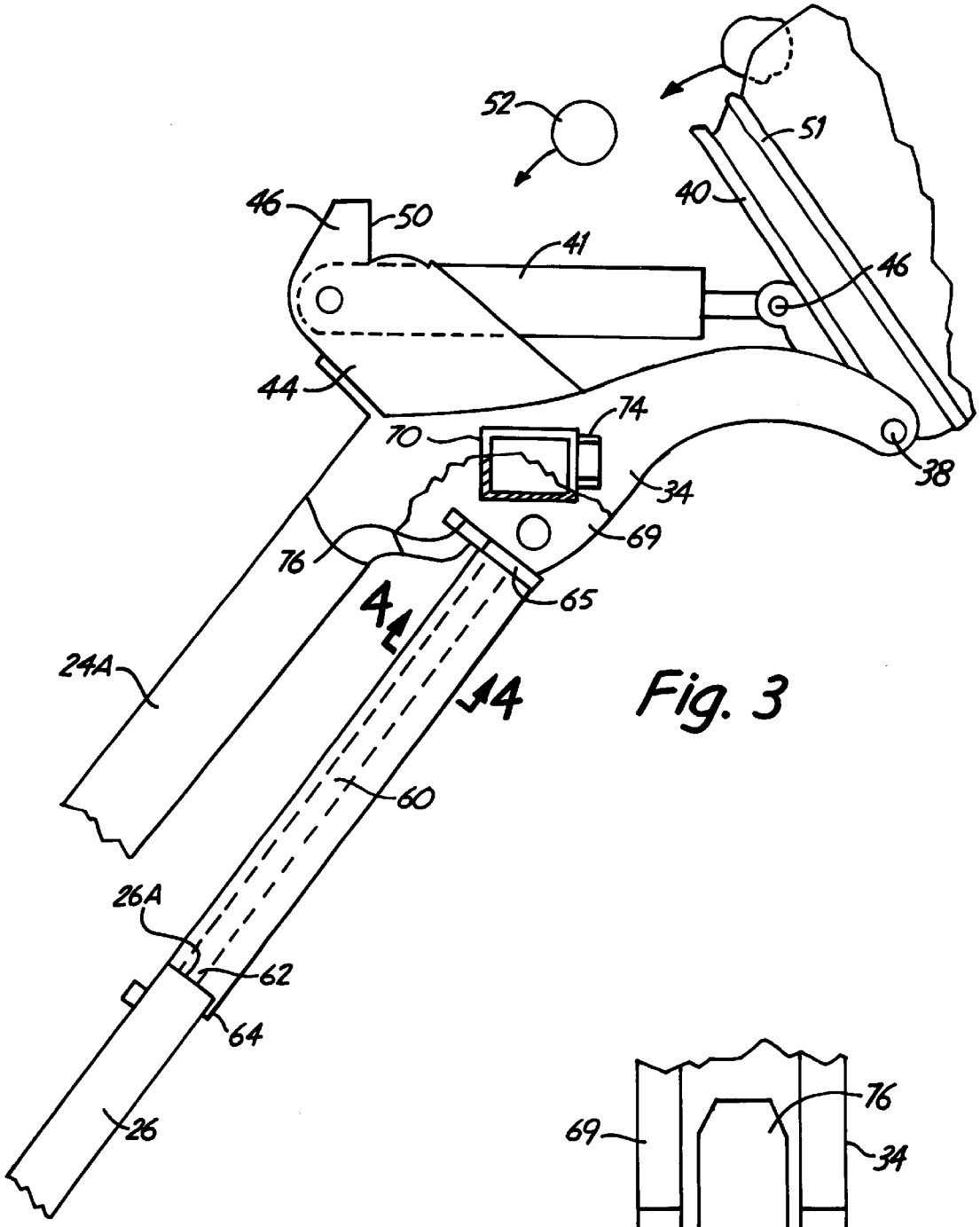
FIG. 3 is a fragmentary enlarged view showing the upper portions of the lift arms in a raised position and a support strut in place.
Figure 4:
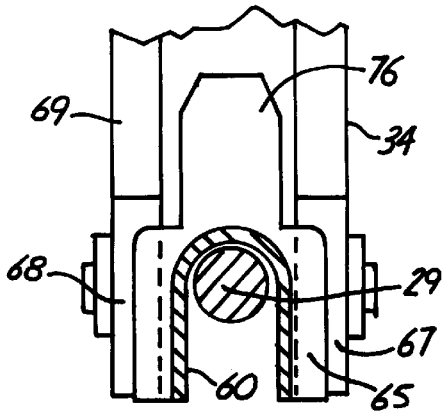
FIG. 4 is a sectional view taken on line 4—4 in FIG. 3.
Figure 5:
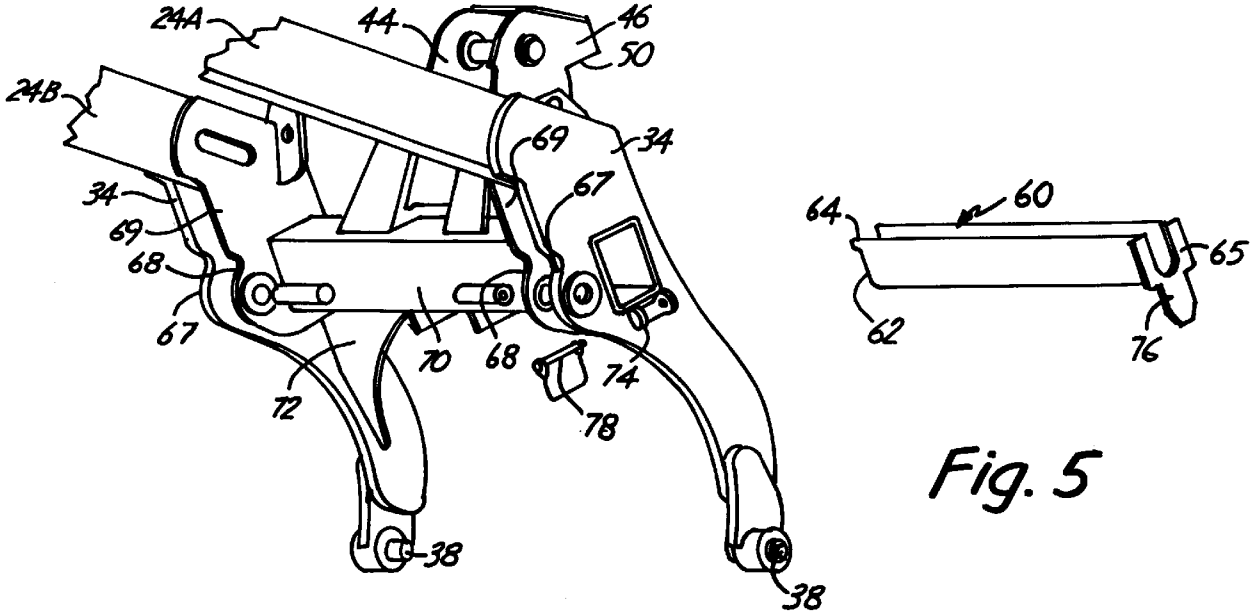
FIG. 5 is a rear fragmentary exploded perspective view of the forward portions of the lift arm assembly, showing the cross tube that holds the lift arms in an assembly and a lift arm mechanical support.
Figure 6:
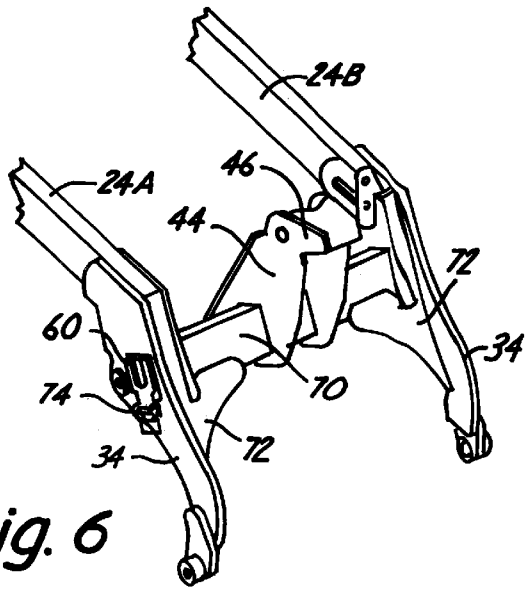
FIG. 6 is a fragmentary front perspective view of an outer end of the lift arms.

When the actuators or cylinders 26 are fully extended, as shown in dotted lines in FIG. 2 the lift arms 24A and 24B are at a substantial upward angle, and as shown in FIGS. 2 and 3, this results in a considerable "roll back" or backward tilt of the rear wall of the bucket 48 when the bucket remains in its position for loading. The upright strut 44 that is used for the bucket cylinder 41, is provided with an upwardly projecting backstop 46, which, as can be seen in FIGS. 5 and 6, is formed by spaced apart plates to provide a lateral width for the backstop. The cylinder 41 fits between these plates. The plates of the backstop form a forward edge 50, that is above the rear lip or corner of the attachment plate 40 and above the back wall 51 of the bucket 48. If the bucket 48 is heaped with objects or chunks of materials, generally as indicated by 52, the excess objects may tend to roll out, backwardly. If this happens the edge 50 of the two spaced plates that form the strut 46 will tend to stop or deflect the objects tending to roll back along the lift arms 24.

When the lift arm assembly 24 is in this raised position, and the engine 45 or other components that are mounted on the body or frame in compartment 17 and above the tracks are to be serviced, a mechanical lift arm support strut 60 is placed between the outer end of one of the cylinders 26 and the lower side of the corresponding lift arm adjacent the outer end of the extendible and retractable rod 29 on that cylinder to the mechanical strut support will insure that the cylinder 26 cannot retract, causing the lift arm assembly 24 to lower.

Mechanical support struts are used on many loaders, and in the compact loader of the present invention, the ability to store such a support strut conveniently and unobtrusively is of prime importance. The storage arrangement is illustrated in FIGS. 3, 4, 5 and 6. The support strut 60 is a channel shaped member that is of size to fit over the cylinder rod 29, and includes a base end 62 that has guides fingers 64 that will position and retain the support strut on the end of the cylinder 26. The base end 62 rests against the end surface 26A of the cylinder 26.

The mechanical lift arm support strut 60 has a flange 65 at the opposite end of the support strut. The flange 65 has a recess aligned with the longitudinal channel opening of the lift arm support strut 60, so it fits over the rod 29 like a saddle. The flange 65 engages the lift arm assembly to provide a support or stop for the lift arm assembly adjacent to the connecting pin or pivot 30 for the rod end on the rod 29 of the cylinder 26. The flange 65 rests against an edge 67 of the forward lift arm portion 34 and an edge 68 of a side skirt of flange 69 that is welded in the lift arm assembly and is spaced from the front portion 34 sufficient to permit the rod end of cylinder rod 29 to fit in the space.

The rectangular tubular cross member 70 forms a structural member and is reinforced to the front lift arm portions 34 with braces 72. The cross member 70 extends across the lift arm assembly. FIGS. 3 and 5 show the right end of the cross member 70. As stated, cross member 70 also provides the main support for the upright strut 44 and the back stop member 46 on the upright strut.

The lift arm support strut 60 is stored inside the rectangular cross section tubular cross member 70, and extends across the lift arm assembly when stored. The lift arm support strut 60 is retained in place in the cross member with a U-shaped bracket 74 on the side of the associated lift arm, which receives a tab or key 76 on the end flange 64 of the strut 60 between side walls of the bracket 74. The flange 65 stays on the outer end of the lift arm and cross member 70, and will not slide into the interior of the cross member. A lock pin 78 is passed through openings in the side walls of the U-shaped bracket 74, and is positioned on the outside of the tab 76 to hold the lift arm support strut 60 in the cross tube 70 during use of the loader.

The lift arm support strut 60 is used to mechanically support the lift arm assembly. The longitudinal channel opening of the strut 60 fits over the rod 29 and abuts against the cylinder end surface 26A. The flange member 65 is placed up near the rod end of the cylinder rod 29. The lift arm support strut rests over the rod 29 and the tab 76 extends upwardly and aligns with the space or recess formed between front lift arm portion 34 and the skirt 69. The tab 76 orients the lift arm support strut so it will not be likely to rotate out of position and fall off.

The cylinder 26 can then be retracted slightly until the edges 67 and 68 engage flange 65 and the tab 76 slides between the forward lift arm portion 24 and the skirt 69. With the guide fingers 64 in position, the lift arm support strut is locked in position, and will not fall out. The lift arms cannot lower until the support strut 60 is removed by reversing the installation sequence.

The lift arm assembly 24 is made to provide a unique support for the tilt cylinder for the bucket, and incorporates in that support a deflector strut that is positioned above the upper edges of the bucket and positioned to deflect objects that may fall out of the bucket when the lift arms are raised fully and the bucket is not kept level.

The controls for operating the lift arms can be conventional valve controls. The propulsion drive motors 16 (there is a motor on each side of the frame) will propel the loader across the ground. There is a separate drive motor 16 for each of the tracks shown, and the drive motors are individually controlled so that the load can be steered as well as being movable in forward direction or reverse direction.

It should be noted that counter weights 86 can be mounted at the rear of the loader, if needed.

Although the present invention has been described with reference to preferred embodiments, workers skilled in the art will recognize that changes may be made in form and detail without departing from the spirit and scope of the invention.

What is claimed is:

1. A loader apparatus having a frame, a lift arm assembly pivotally mounted on the frame and movable between a raised and a lowered position, the lift arm assembly comprising spaced apart lift arms, and a cross member spaced from the pivotal mounting of the lift arm assembly holding the lift arms together to form the assembly, a hydraulic cylinder having an extendible or retractable rod connected between the frame and the lift arm assembly, a mechanical support for supporting compression loads mountable on the rod of the cylinder when extended to support the lift arm assembly, the mechanical support being positioned between an end of the cylinder and the lift arm assembly to prevent the lift arm assembly from lowering when the mechanical support is in place, the mechanical support having a base end for engaging an end of the cylinder, the base end having finger projections for fitting over a side of the cylinder when the base end is resting on the end of the cylinder, and having a flange at an opposite end from the base end for engaging a portion of the lift arm assembly, the portion of the lift arm assembly defining a space and the flange having a tab extending outwardly and fitting into the defined space when the support is in a working position between the end of the cylinder and the portion of the lift arm assembly to prevent rotation of the mechanical support, the cross member being tubular and having an interior opening open through an access opening through at least the lift arm on one side of the lift arm assembly, said cross member interior opening and access opening being of size to receive the mechanical support to store the support.

2. The apparatus of claim 1, wherein there is a retainer bracket on the lift arm on the one side of the lift arm assembly, and the tab on the flange of the mechanical support engaging the retainer bracket when the mechanical support is stored in the cross member.

3. The apparatus of claim 1, and a releasable latch for holding the tab of the mechanical support in position on the retainer bracket within the interior opening of the cross member.

4. The apparatus of claim 1, wherein said cross member is rectangular in cross section.

5. The apparatus of claim 3, wherein said mechanical support has a length less than a length of the cross member.

6. The apparatus of claim 1, wherein said cross member supports an upright strut, a bucket mounted at an outer end of said lift arm assembly, and said upright strut supporting an actuator for controlling movement of the bucket about a horizontal axis, the upright strut having an upward extension forming a deflector extending above the upper edge of a bucket when the lift arms are in a fully raised position.

7. A lift arm assembly for a loader including a pair of lift arms, a frame for pivotally mounting rear portions of the lift arms to the loader, extendable and retractable lift cylinders for pivoting the lift arm assembly between a lowered and a raised position, a tubular cross member at forward ends of the lift arms, for holding the lift arms spaced apart and in an assembly, the tubular cross member defining a central interior opening, and an access opening passing through a side of at least one lift arm and aligning with the central interior opening so the central interior opening is open on a lateral side of at least one lift arm, and a compression carrying support strut mountable over a rod of a lift cylinder with the rod extended and the lift arms in the raised position for supporting the lift arm assembly relative to an end of a lift cylinder, the support strut being of size to be slidable into the interior opening of the tubular cross member, and removable from said tubular cross member through the access opening in the side of the one lift arm, and a retainer on the exterior of the one lift arm to hold the support strut in the interior opening of the tubular cross member during use of the lift arm assembly.

8. The lift arm assembly of claim 7, and an upright on said cross member substantially centered on the lift arm assembly, said upright extending sufficiently upwardly to project above a rear portion of a work tool held at the outer end of the lift arm assembly when the lift arm assembly is in a raised position.

9. The lift arm assembly of claim 8, wherein said lift arm assembly has a hydraulic tilt cylinder for controlling movement of the work tool about a horizontal axis, said hydraulic tilt cylinder having a base end mounted on said upright.

10. A lift arm assembly for a loader having operator controls at a rear of the loader, the loader being operated by an operator positioned at the rear of the loader and to a rear of the controls, the lift arm assembly comprising a pair of spaced apart lift arms, a cross member at forward ends of the lift arms, pivots at the rear portions of the lift arms for pivotally mounting the lift arms to supports at the rear of the loader adjacent the controls, whereby the lift arms are positioned forwardly from an operator using the controls, an attachment plate for a bucket mounted to the forward ends of the lift arms for movement about a horizontal axis, an upright strut fixed in position on said cross member and extending upwardly therefrom, and a hydraulic cylinder having one end mounted to the upright strut and a second end pivotally connected to the attachment plate for controlling tilting of the attachment plate and an attached bucket about the horizontal axis directly by movement of a rod of the hydraulic cylinder, the bucket attached to the attachment plate having a rear wall with a top edge, and the lift arms being pivotal about the pivots at the rear portions to a raised position wherein the forward ends of the lift arms are raised and the lift arms extend upwardly at an angle, and the strut including a deflector extension fixed on the upright strut, the deflector extension extending upwardly at the base end of the hydraulic cylinder above the mounting of the hydraulic cylinder to the strut and protruding laterally outwardly from the hydraulic cylinder with the lift arms in the raised position to provide for deflecting objects rolling over the top edge of the rear wall of the bucket attached to the mounting plate when the forward ends of the lift arms are in a raised position.

11. The lift arm assembly of claim 10, wherein said cross member is tubular, and has an open end opening through one lift arm and accessible from an outer side of the one lift arm.

12. The lift arm assembly of claim 10, wherein said deflector extension has a forward leading edge and comprises two spaced plates to provide a lateral width.

13. The lift arm assembly of claim 11 and a mechanical support member for supporting the lift arms in a raised position, said mechanical support member being insertable into the opening of the cross member for storage.

* * * * *